US006061861A

United States Patent [19]

Shibamiya et al.

[11] Patent Number: 6,061,861

[45] Date of Patent: May 16, 2000

[54] EQUIPMENT FOR REMOVING A RESIN JOINT FROM THE PIPE FITTED WITH THE RESIN JOINT, AND EQUIPMENT FOR REMOVING A RESIN JOINT OR RESIN RIBS FROM THE PIPE FITTED WITH SUCH A JOINT OR RIBS

[75] Inventors: Toshio Shibamiya; Haruo Fujita; Mituo Abe; Tatsuo Matsumoto, all of Shizuoka, Japan

[73] Assignee: Yazaki Industrial Chemical Co., Ltd., Shizuoka, Japan

[21] Appl. No.: 09/200,974

[22] Filed: Nov. 30, 1998

[51] Int. Cl.[7] ..... E21B 33/08

[52] U.S. Cl. ..... 15/104.04; 15/93.1

[58] Field of Search ..... 15/93.1, 104.04, 15/104.03

[56] References Cited

U.S. PATENT DOCUMENTS

| | | | |
|---|---|---|---|
| 2,782,436 | 2/1957 | Tomer | 15/104.04 |
| 2,813,285 | 11/1957 | Aslin et al. | 15/104.04 |
| 5,136,969 | 8/1992 | Chapman | 15/104.04 |
| 5,199,226 | 4/1993 | Rose | 15/104.04 |
| 5,398,461 | 3/1995 | Rose | 15/104.04 |
| 5,458,683 | 10/1995 | Taylor et al. | 15/104.04 |
| 5,512,104 | 4/1996 | Mizushiri et al. . | |
| 5,842,252 | 12/1998 | Cameron et al. | 15/104.04 |

FOREIGN PATENT DOCUMENTS

B2-2533465 6/1996 Japan .

*Primary Examiner*—Terrence R. Till
*Attorney, Agent, or Firm*—Oliff & Berridge, PLC

[57] ABSTRACT

This invention relates to (1) the equipment for removing easily a resin joint from the pipe having the resin joint adhered and fitted thereto at or near its one end or for removing a resin joint from the pipe having the resin joint adhered and fitted thereto at the middle point of the pipe; and (2) the equipment for removing easily a resin joint or resin ribs from the pipe having the resin joint adhered and fitted thereto and covered with resin ribs, in a manner capable of recovering each of the pipe and the resin separately.

6 Claims, 19 Drawing Sheets

EQUIPMENT FOR REMOVING A RESIN JOINT FROM THE PIPE FITTED WITH THE RESIN JOINT, AND EQUIPMENT FOR REMOVING A RESIN JOINT OR RESIN RIBS FROM THE PIPE FITTED WITH SUCH A JOINT OR RIBS

TECHNICAL FIELD OF THE INVENTION

This invention relates to the equipment for removing a resin joint from mainly cylindrical resin-coated steel pipe (hereinafter referred to as pipe) having a resin joint adhered and fitted thereto at its one end and for obtaining the steel pipe capable of recycling for further use. This invention relates also to the equipment for removing a resin joint or resin ribs from the resin-coated pipe having a resin joint adhered and fitted thereto at its middle point or from the pipe having all or part of the outer surface covered with resin ribs, and recovering separately the exposed cylindrical steel pipe and the resin.

BACKGROUND OF THE INVENTION

Conventionally, there were two methods for removing a resin joint or resin ribs:

(a) The resin joint was removed by pushing a minus screw driver into the gap between the pipe and the resin joint, or by using a saw or other cutting means to cut off the resin joint, if the joint was removed from the pipe having the joint adhered and fitted thereto at one end or at a middle point of the pipe, as in the cases of the pipe remaining after a structure had been disassembled or the pipe fitted with a resin joint at a wrong position; and (b) If resin ribs were removed from the cylindrical pipe having them formed on its surface, there had to be provision for various types of feed rolls and work coils which corresponded to the shapes of the resin ribs. These ribs were removed by transferring the feed rolls and the work coil in the axial direction, heating the ribs to soften them, and scraping them by a scraping means.

However, these conventional methods have the following problems:

(a) If a resin joint is removed from the pipe by inserting a minus screw driver to break the joint or by cutting the pipe with a saw, the pipe itself and the resin coating are damaged and they are spoiled aesthetically. It is difficult to measure the saw-cut pipe with high precision. Even if the saw-cut pipe is reprocessed, the pipe inevitably gets shorter in length and finds less opportunity for reuse.

(b) If resin ribs are removed from pipe, there must be various types of feed rolls and work coils in response to the shapes of the resin ribs. Therefore, it takes much time to plan the work of removing (peeling) resin ribs from the pipe. Work is impossible with a single type of feed rolls and a single work coil.

SUMMARY OF THE INVENTION

An object of this invention is to provide the equipment for easily removing a resin joint from the pipe having the joint adhered and fitted thereto at or near its one end. Another object of this invention is to provide the equipment for easily removing a resin joint from the pipe having the joint adhered and fitted thereto at a middle point or the equipment for easily removing a resin joint or resin ribs from the pipe fitted with the resin joint and covered with the resin ribs, in a manner enabling each material to be recovered separately.

The above-described objects are achieved by the equipment for removing a resin joint from the pipe fitted with the resin joint, wherein the equipment is characterized by comprising:

A fixed plate; a cylinder plate having a cylinder fitted perpendicularly to the outer surface thereof, said cylinder being fitted with a piston rod extending from said cylinder and passing through a hole opened in the approximately central area of said cylinder plate; a frame on which to mount said fixed plate and said cylinder plate, to connect them with each other by stay shafts at a given space apart and in the positions parallel to each other, and to fix them; and a moving plate disposed between said fixed plate and said cylinder plate, which is fixed to the tip of said piston rod in a manner horizontally moving along said stay shafts as said piston rod moves forward or backward;

A lower clamp portion of a V-shape disposed on the upper central area of said cylinder plate to support the pipe portion of the pipe fitted with a resin joint or two; and a clamp provided in its lower area with an upper clamp portion of a reverse-V shape disposed right above said lower clamp portion and provided in its upper area with guide holes to make guide shafts pass through said holes in a horizontally movable manner, said clamp being fitted in a vertically movable manner to the tip of the piston rod of a cylinder vertically fixed to a cylinder mount vertically installed on said cylinder plate; and A V-shaped pipe support disposed in the upper central area of said moving plate, which together with said lower clamp portion, holds the pipe portion horizontally; a guide rod vertically disposed in proximity to said pipe support; a lower scraper mount fixed to the inner surface of said moving plate; a lower scraper in the shape of a lower half circle, such as obtained by horizontally dividing into two halves a circle with a bore slightly larger than the outer diameter of the pipe portion, said lower scraper being provided with blades fitted thereto, which are directed toward the fixed plate; and an upper scraper, i.e., the other half of the scraper, being disposed right above said lower scraper and facing it correspondingly and being fitted to an upper scraper mount in a manner vertically moving along the guide rod, said upper scraper mount being fixed to one ends of the guide shafts, with the other ends being allowed to pass slidably through the guide holes of the aforementioned clamp.

The equipment for removing a resin joint from the pipe fitted with the resin joint is characterized in that the upper scraper mount according to claim 1 is fitted in a vertically movable manner to the tip of the piston rod of said cylinder installed vertically on top of the moving plate.

The equipment for removing a resin joint or resin ribs from the pipe fitted with a resin joint or resin ribs is characterized by comprising:

A fixed plate; a cylinder plate having a cylinder fitted perpendicularly to the outer surface thereof, said cylinder being fitted with a piston rod extending from said cylinder and passing through a hole opened at a given position of said cylinder plate; a frame on which to mount said fixed plate and said cylinder plate, to connect them with each other by stay shafts at a given space apart and in the positions parallel to each other, and to fix them; and a moving plate disposed between said fixed plate and said cylinder plate, which is fixed to the tip of said piston rod in a manner horizontally moving along said stay shafts as said piston rod moves forward or backward;

An extruding pin disposed in the approximately central area of said moving plate, with its conical head being directed horizontally toward said cylinder plate;

A pipe hole being open in said cylinder plate at a position opposite to said extruding pin and having a bore slightly larger than the outer diameter of the pipe portion; and a scraper provided with a circular opening and disposed on the inner surface of said cylinder plate, said opening having a bore roughly identical with the bore of said pipe hole, with a cutter being disposed coaxially with the pipe hole and directed toward said extruding pin;

A fitting plate fixed to the outer surface of said cylinder plate in its upper area so that about a part of said fitting plate is projected upward from the top edge of said cylinder plate; a piston rod hole being open in said projected area; a cylinder disposed perpendicularly to the inner surface of said fitting plate and provided with a piston rod which is horizontally movable in the outward direction through said piston rod hole; guide pins fitted to the outer surface of said fitting plate in parallel to the direction in which said piston rod moves forward or backward; a support plate disposed next to and on the outside of said fitting plate and having guide pin holes in the upper area of said support plate to allow said guide pins to pass through; a centering pin fixed perpendicularly to the lower area of said support plate so that said pin can be passed through the pipe hole, with the conical pin head directed toward the extruding pin; and a slider provided with a slide roller and fixed perpendicularly to said support plate which, in turn, is fitted rotatably to the tip of said piston rod; and A guide plate disposed on the outer surface of said cylinder plate and organized by a straight groove which is engaged with said slide roller to enable said centering pin to be moved linearly inside said groove and guided in the axial direction of said pipe hole, and by an escape groove which is used to make said centering pin get out of the passageway of the pipe in parallel to the axial direction of said pipe hole.

The equipment for removing a resin joint or resin ribs from the pipe fitted with a resin joint or resin ribs is characterized by comprising:

A fitting plate disposed in such a way that a part of said fitting plate is projected horizontally from the side edge of said cylinder plate and fixed at its overlapped base area to the outer surface of said cylinder plate; a piston rod hole being open in the area of the fitting plate that is projected from the edge of the cylinder plate; a cylinder installed perpendicularly to the inner surface of said cylinder plate and provided with a piston rod which passes through said piston rod hole and extends outward in a manner horizontally moving forward or backward; guide pins disposed on the outer surface of said fitting plate in parallel to the direction in which said piston rod moves forward or backward; a support plate fitted on the outside of said fitting plate in proximity and parallel thereto; and a guide plate fixed perpendicularly to the outer surface of said cylinder plate, with said escape groove turning upward.

The equipment for removing a resin joint or resin ribs from the pipe fitted with a resin joint or resin ribs is characterized in that said scraper according to claims 3 or 4 has a sharp cutter, with its blades being disposed radially from the axis.

The equipment for removing a resin joint or resin ribs from the pipe fitted with a resin joint or resin ribs is characterized in that said scraper for removing resin ribs is provided with a disc-like shield and a hollow portion in the approximately central area of said disc, and that said hollow portion has a bore slightly larger than the outer diameter of the pipe portion and has a ring-like cutter with a wedge-shaped cross-section, which is disposed along the inner circumference of said cutter.

BRIEF DESCRIPTION OF THE DRAWINGS

FIG. 14-B, a front view of the scraper.

FIG. 15-B, a front view of the scraper used to remove resin ribs.

DESCRIPTION OF THE PREFERRED EMBODIMENTS

Referring to FIGS. 1–7, there is illustrated the equipment of the first embodiment of this invention. The equipment 1 of the first embodiment is particularly adapted to remove resin joints 16*b* and 16*c* (FIG. 10) from the pipe 16 having a resin joint (or two) adhered and fitted thereto at or near its one end (or both ends), by pushing out the joint from the pipe or by breaking and peeling it off the pipe.

Figure 1:
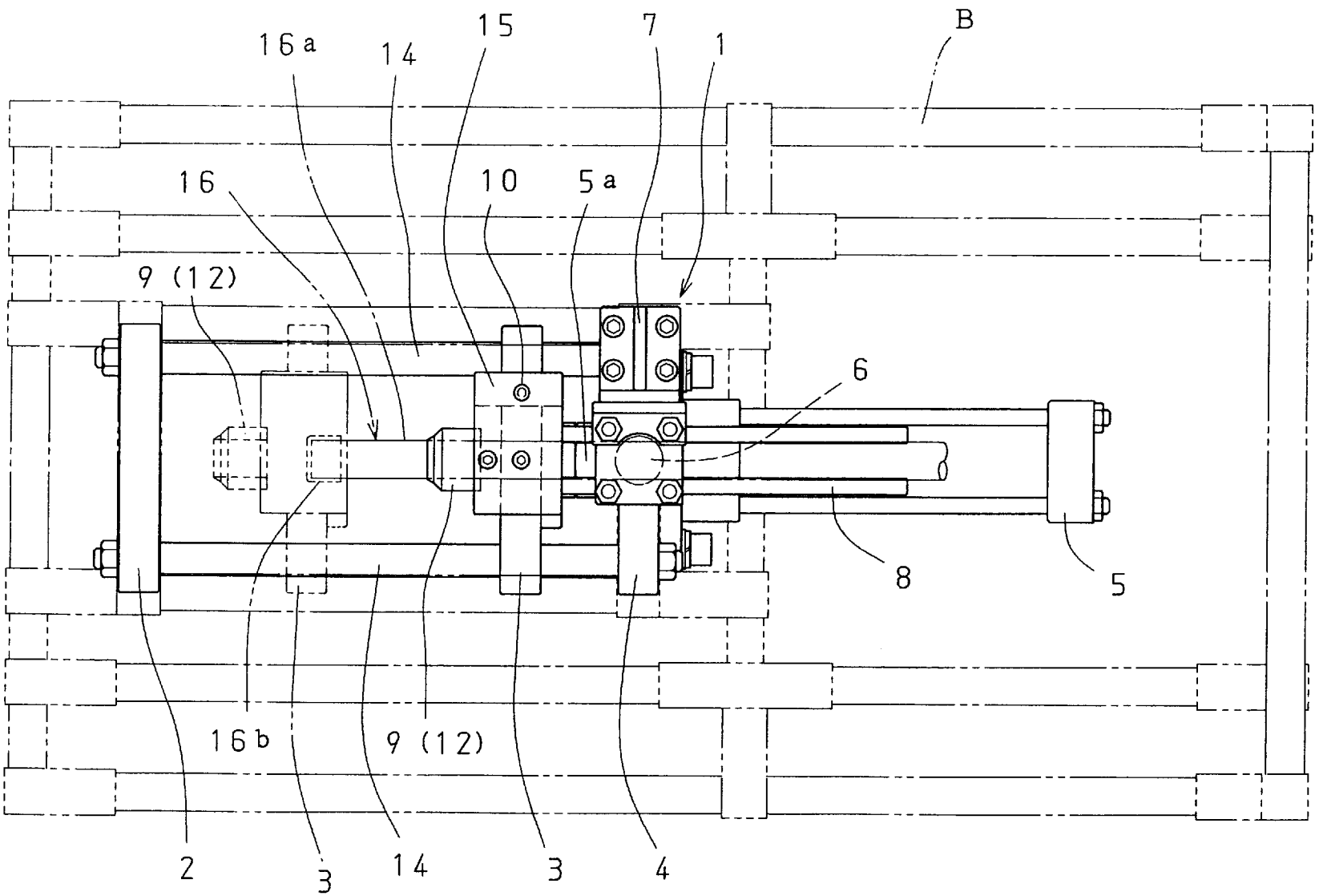
FIG. 1 is a plan view of the equipment of the first embodiment according to this invention.
Figure 2:
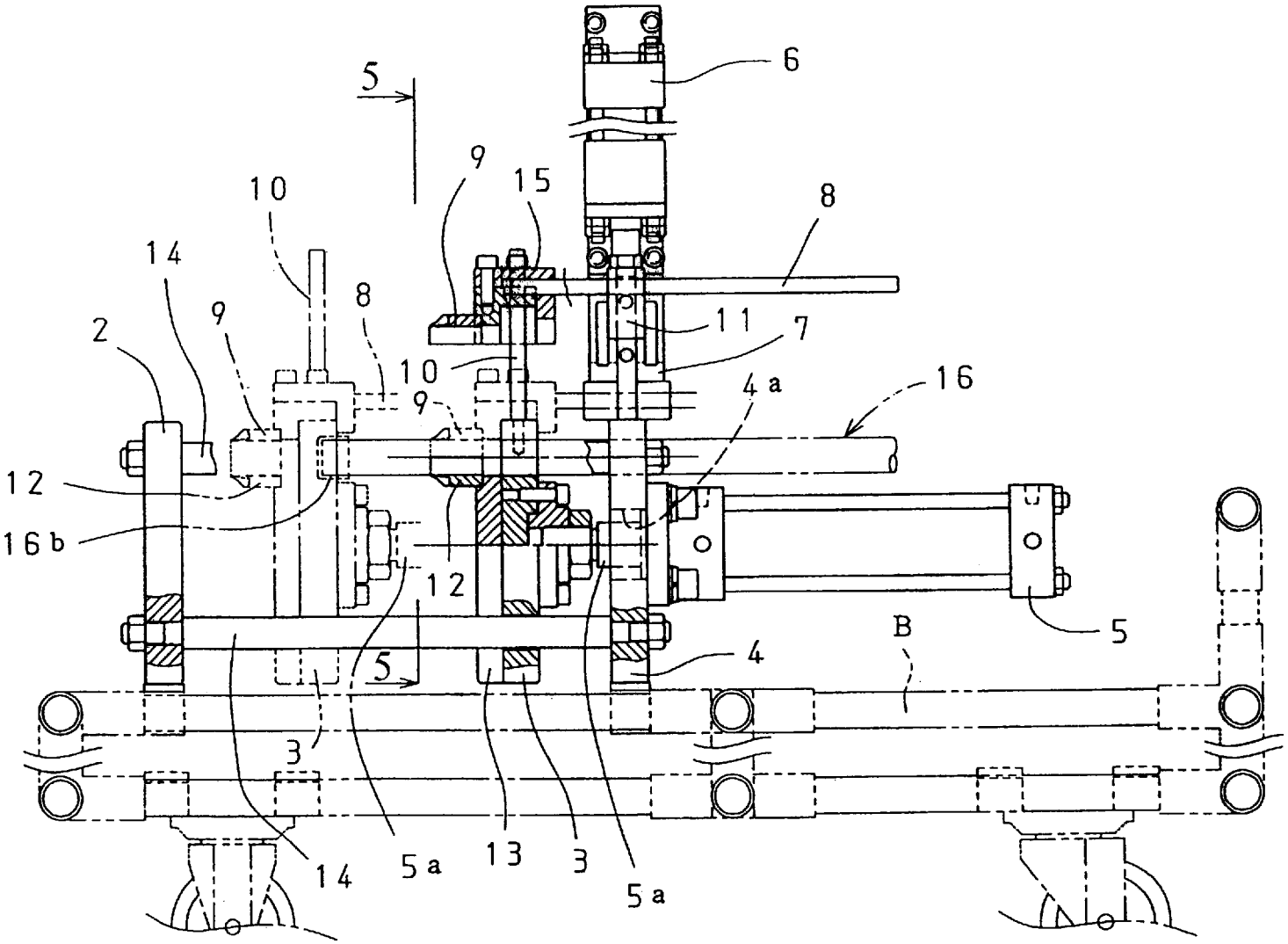
FIG. 2 is a partially cross-sectional front view of the equipment of the first embodiment according to this invention.

As shown in FIGS. 1 and 2, there is provided a frame B which is assembled from pipes and the resin joints to connect them. A fixed plate 2 is disposed on the frame B at its one end (on the left side of the drawings), and a cylinder plate 4 in the shape almost identical with the fixed plate, at the other end (on the right side). Both plates are connected with each other by stay shafts 14 at a given space apart and in the positions parallel to each other, and are fixed in place on the frame B by given fixing means.

A hole 4*a* is drilled through the cylinder plate 4 in the approximately central area. A cylinder 5 is fitted perpendicularly to the plate on its outer surface so that piston rod 5*a* can be passed through the hole 4*a*.

Between the aforementioned fixed plate 2 and the cylinder plate 4 there is disposed a moving plate 3, which is fixed to the tip of the piston rod 5*a* and is movable in the left or right direction along the stay shafts 14 by the action of the piston rod 5*a* as it moves back and forth.

In the upper central area of the cylinder plate 4 is disposed a V-shaped lower clamp portion 4*b* which supports the pipe portion 16*a* of the pipe 16 fitted with a resin joint. A clamp 11 is disposed right above the lower clamp portion 4*b*. The clamp 11 has an upper clamp portion 11*a* of a reverse-V shape at its bottom, and this portion 11*a* clamps the upper area of the cylinder plate 4 from both sides, and at the same time, it is engaged with the lower clamp portion 4*b* to position the pipe at its axial center. Two guide holes 11*b* are open in the upper area of the clamp 11 to make guide shafts 8 pass through them and move horizontally.

Furthermore, the clamp 11 is fitted in a vertically movable manner at the tip of the piston rod 6*a* of the cylinder 6. Cylinder support 7 is vertically fitted on top of the cylinder plate 4. The cylinder 6 is thus located next to the cylinder support 7 and fitted thereto, each in its vertical position (FIGS. 3 and 7).

Figure 3:
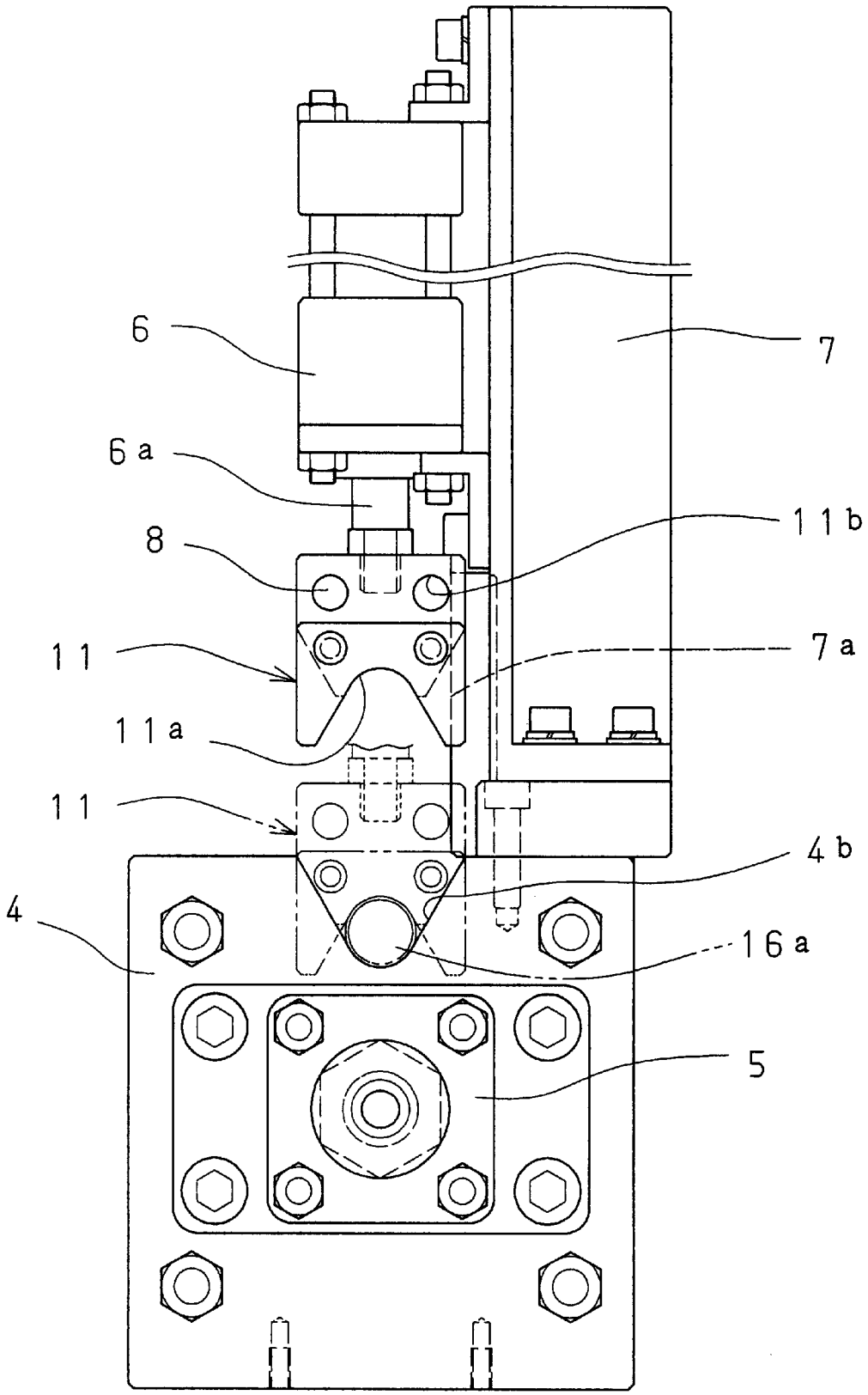
FIG. 3 is a side view showing the cylinder plate and clamp portion.
Figure 4:
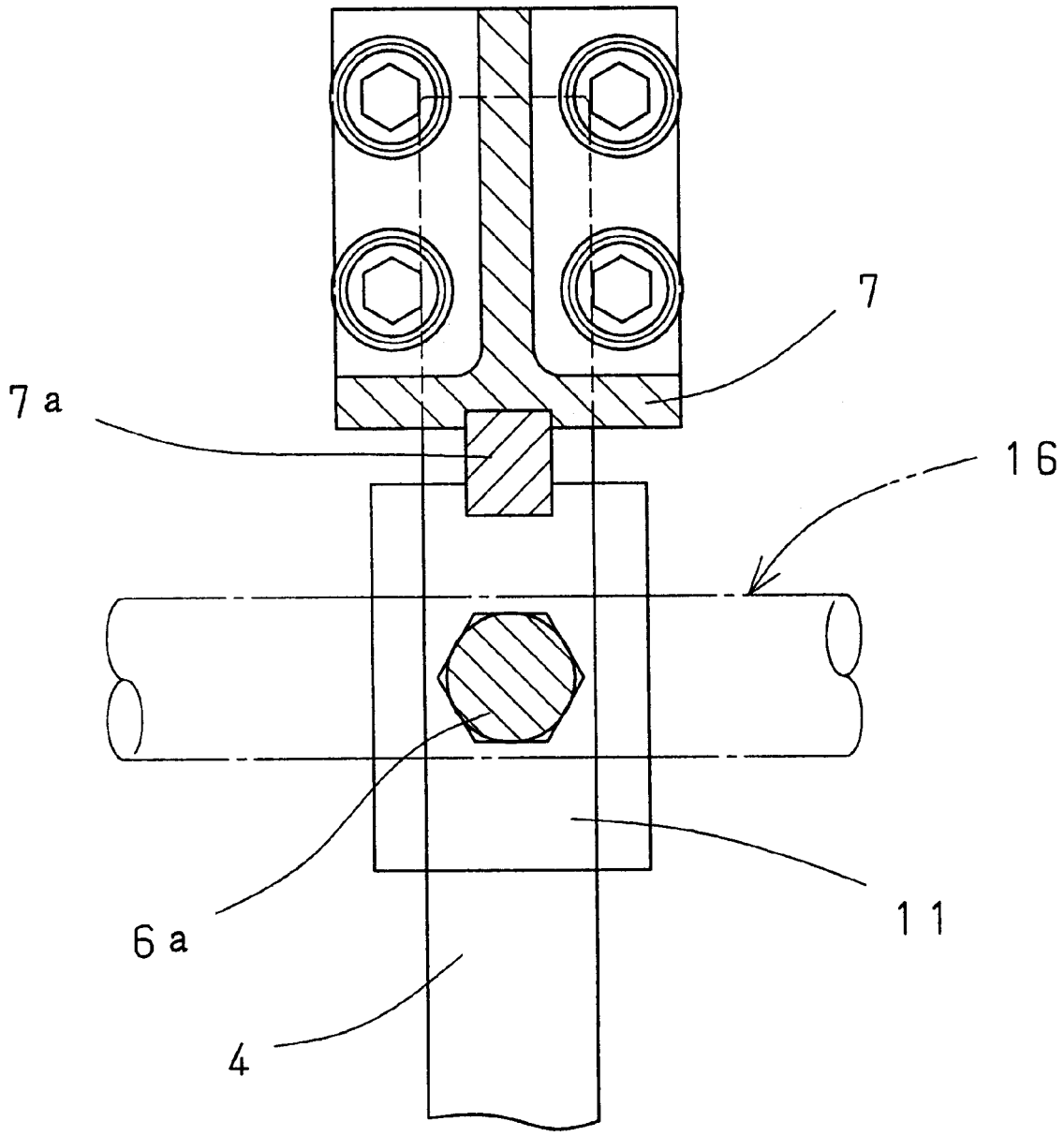
FIG. 4 is a cross-sectional view taken at the 4—4 line of FIG. 7B.
Figure 7:
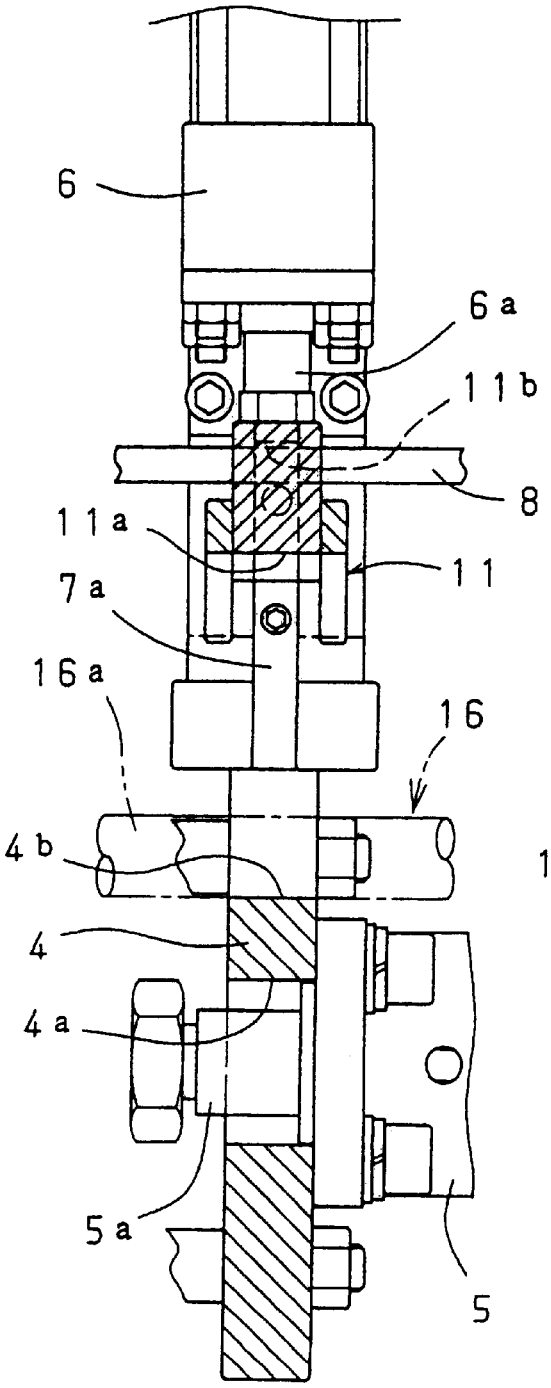
FIG. 7 is longitudinal cross-sectional views of an enlarged section of equipment according to this invention, wherein the clamp is ascending and descending.
Figure 7:
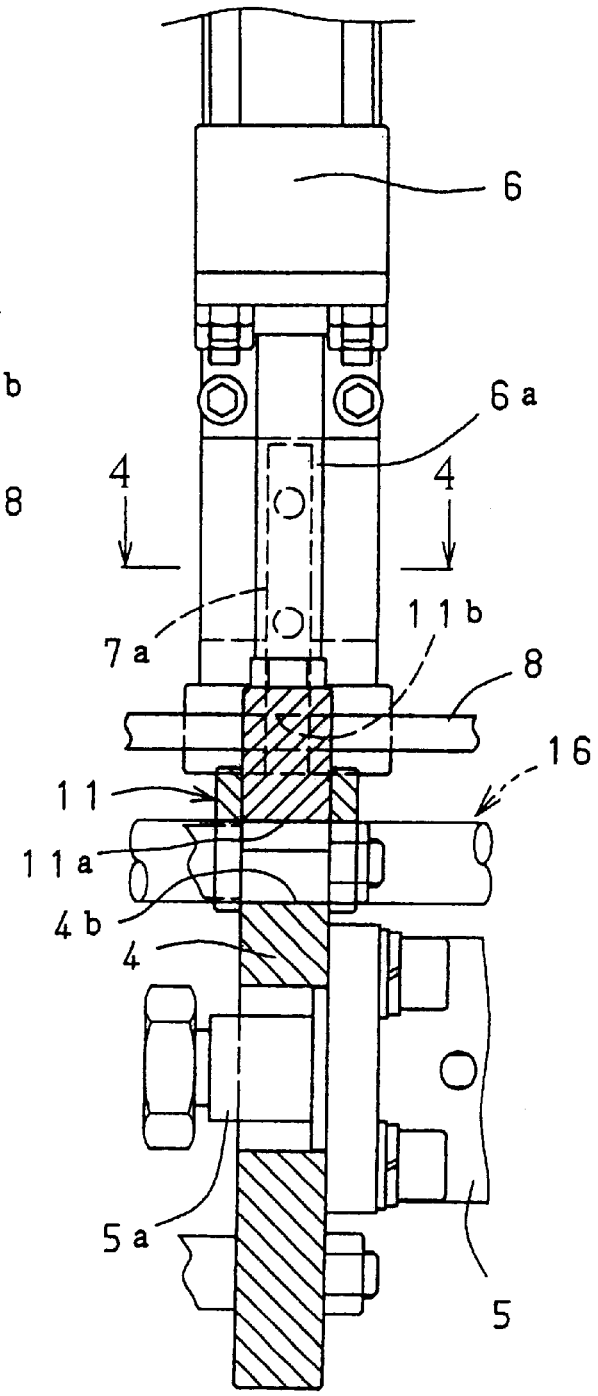

The aforementioned clamp 11 is guided by a guide 7*a* disposed on the front side of the cylinder 7 so that it can be moved vertically with high precision (FIGS. 3, 4, and 7). FIG. 7 shows a longitudinal cross-sectional view of an enlarged section of the clamp 11, wherein it is ascending (FIG. 7A) and the same view of the clamp 11, wherein it is descending (FIG. 7B).

Figure 5:
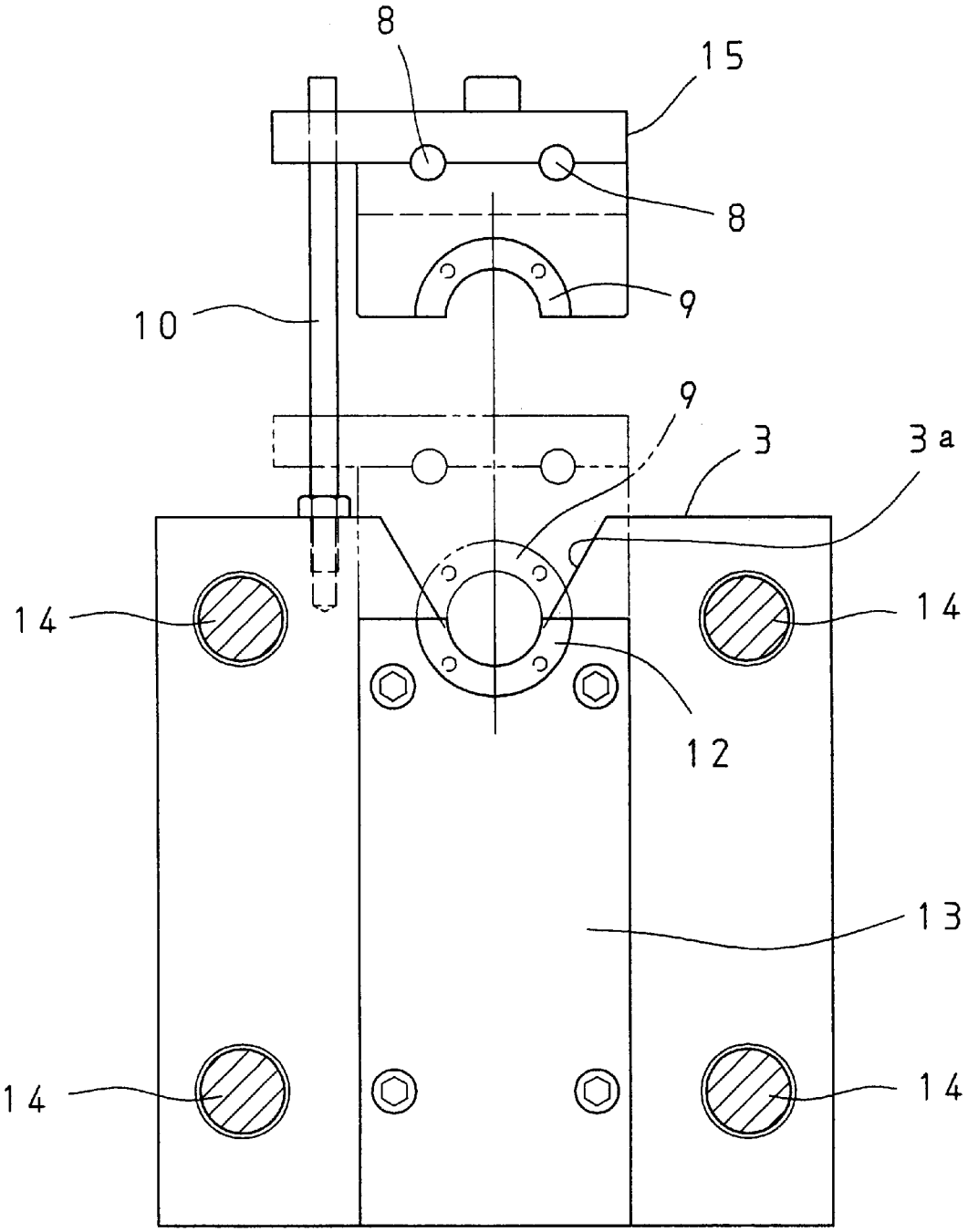
FIG. 5 is a cross-sectional view taken at the 5—5 line of FIG. 2.

A V-shaped pipe support 3*a* is disposed in the upper central area of the aforementioned moving plate 3, as shown in FIG. 5, and is used along with the lower clamp portion 4*b* to hold the pipe portion 16*a* horizontally. A guide rod 10 is vertically disposed in proximity to the pipe support 3*a*.

A lower scraper mount 13 is installed on the inner surface (the left side in FIGS. 1 and 2) of the moving plate 3. The lower scraper 12 is in the shape of a lower half circle, as obtained by horizontally dividing a circle with a bore slightly larger than the outer diameter of the pipe portion 16*a*, and has blades fitted thereto, which are directed toward the fixed plate 2. Right above the lower scraper 12 is upper scraper 9, i.e., the other semi-circle of the scraper, facing the lower scraper 12 correspondingly. The upper scraper 9 is fitted to upper scraper mount 15 in a manner vertically moving along the guide rod 10.

In addition, the aforementioned upper scraper mount 15 is fitted to one ends of the guide shafts 8, and the other ends of the guide shafts 8 are passed through the guide holes 11*b* of the clamp 11 in a horizontally slidable manner, so that the upper scraper mount 15 moves interlockingly with the clamp 11 as the latter moves vertically.

A pair of the aforementioned upper and lower scrapers 9 and 12 softly catches the pipe portion 16*a*, and then pushes out the resin joint 16*b* or breaks it.

Preferably, the pipe support 3*a* has the semi-circle with its diameter being similar to the bore of the lower scraper 12. In FIG. 5, the semi-circle of the pipe support 3*a* has roughly the same shape and size of the bore of the lower scraper 12.

Figure 6:
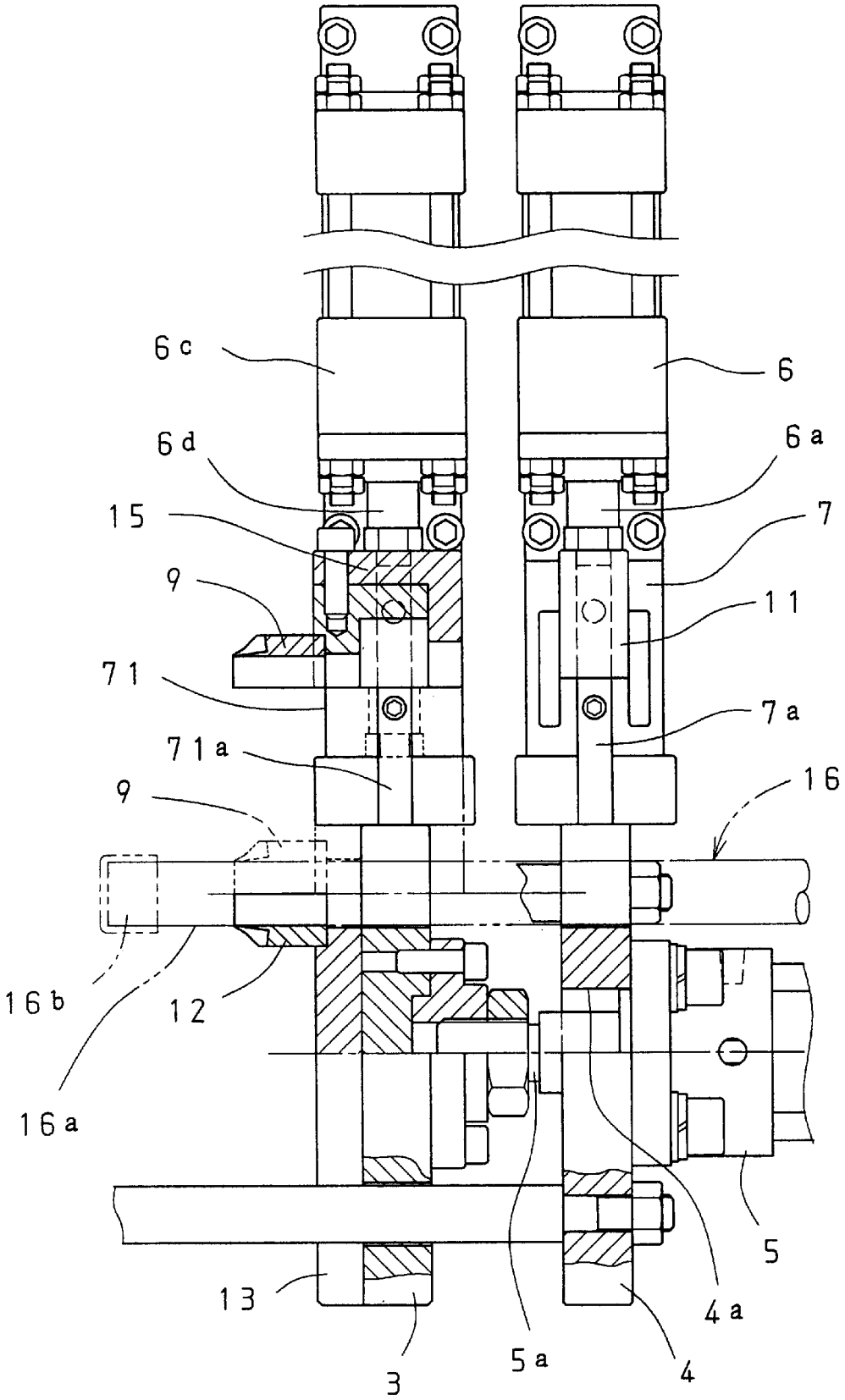
FIG. 6 is a longitudinal cross-sectional view of an enlarged section of equipment according to this invention, wherein the upper scraper is actuated by the cylinder.

FIG. 6 shows an embodiment of the scraper wherein the upper scraper mount 15 is vertically descended or ascended by the cylinder 6*c* which is installed separately. The upper scraper mount 15 fixes the cylinder mount 71 almost vertically on top of the moving plate 3. The mount 15 is guided by the guide 71*a* fitted on the front side of the cylinder mount 71, and is attached in a vertically movable manner to the tip of the piston rod 6*d* of the cylinder 6*c* which is installed vertically on the cylinder mount 71.

When the resin joint 16*b* or 16*c* is removed from the pipe 16 having the resin joint or joints adhered and fitted thereto at or near one end or both ends, the resin joint(s) 16*b* and/or 16*c* is positioned between the fixed plate 2 and the moving plate 3. The pipe portion 16*a* is held horizontally by the lower clamp 4*b* and the pipe support 3*a*.

The cylinder 6 is then driven to extend the piston rod 6*a*. The rod goes down and the upper clamp portion 11*a* pushes down the pipe portion 16*a*. At the same time, with the descent of the clamp 11, the upper scraper 9 fitted to the upper scraper mount 15 goes down as it is guided by the guide shaft 10. The upper and lower scrapers 9 and 12 thus lightly catch the pipe portion 16*a*.

If the upper scraper mount 15 is separately moved up- or downward by the cylinder 6*c*, as in the embodiment of FIG. 6, the mount can be operated simultaneously with the cylinder 6, or it can be operated separately.

As depicted in the two-dot long-dash lines in FIG. 2, when the moving plate 3 is moved toward the fixed plate 2 by the extension of the piston rod 5*a*, the upper and lower scrapers 9 and 12 remove the resin joint(s) 16*b* and/or 16*c* by pushing them out, or by breaking and peeling them off.

If the resin joints 16*b* are adhered and fitted to both ends of the pipe, the pipe 16 is reset in the opposite direction for the second removal after the first joint has been removed from one end.

Now referring to FIGS. 8–16, there is illustrated the equipment 20 of another embodiment of this invention. The equipment 20 of this embodiment is used to remove a resin joint or resin ribs from the pipe fitted with the resin joint or resin ribs, wherein the resin joint 16*c* is removed from the pipe 16 having the joint 16*c* adhered and fitted thereto at a middle point of the pipe along its axial length. In addition, it is used to peel the resin ribs 16*d* (See FIG. 15A) off the outer surface of the cylindrical pipe and to recover bare cylindrical pipe and resin for recycling.

Figure 8:
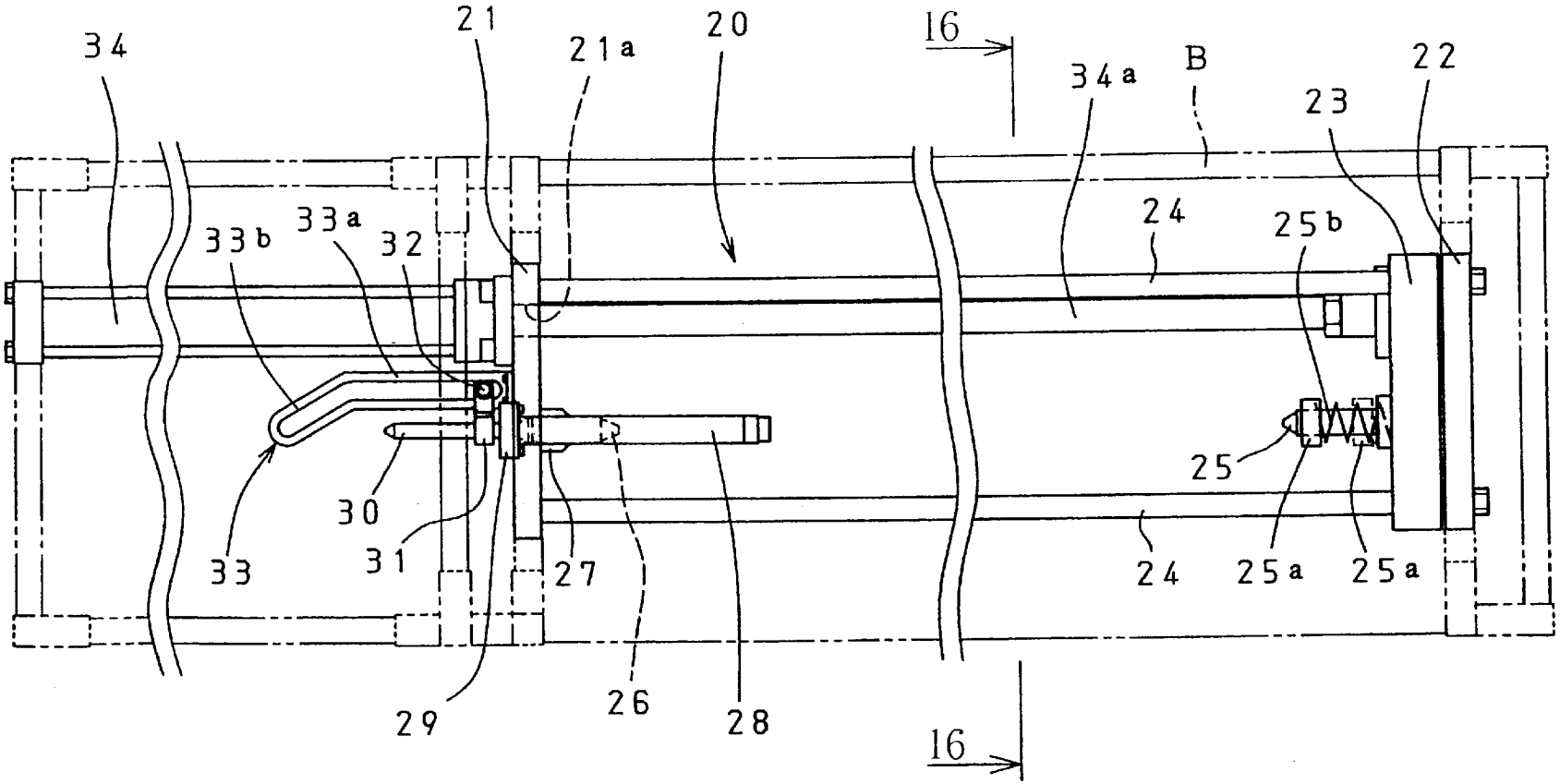
FIG. 8 is a plan view of the second embodiment according to this invention.
Figure 9:
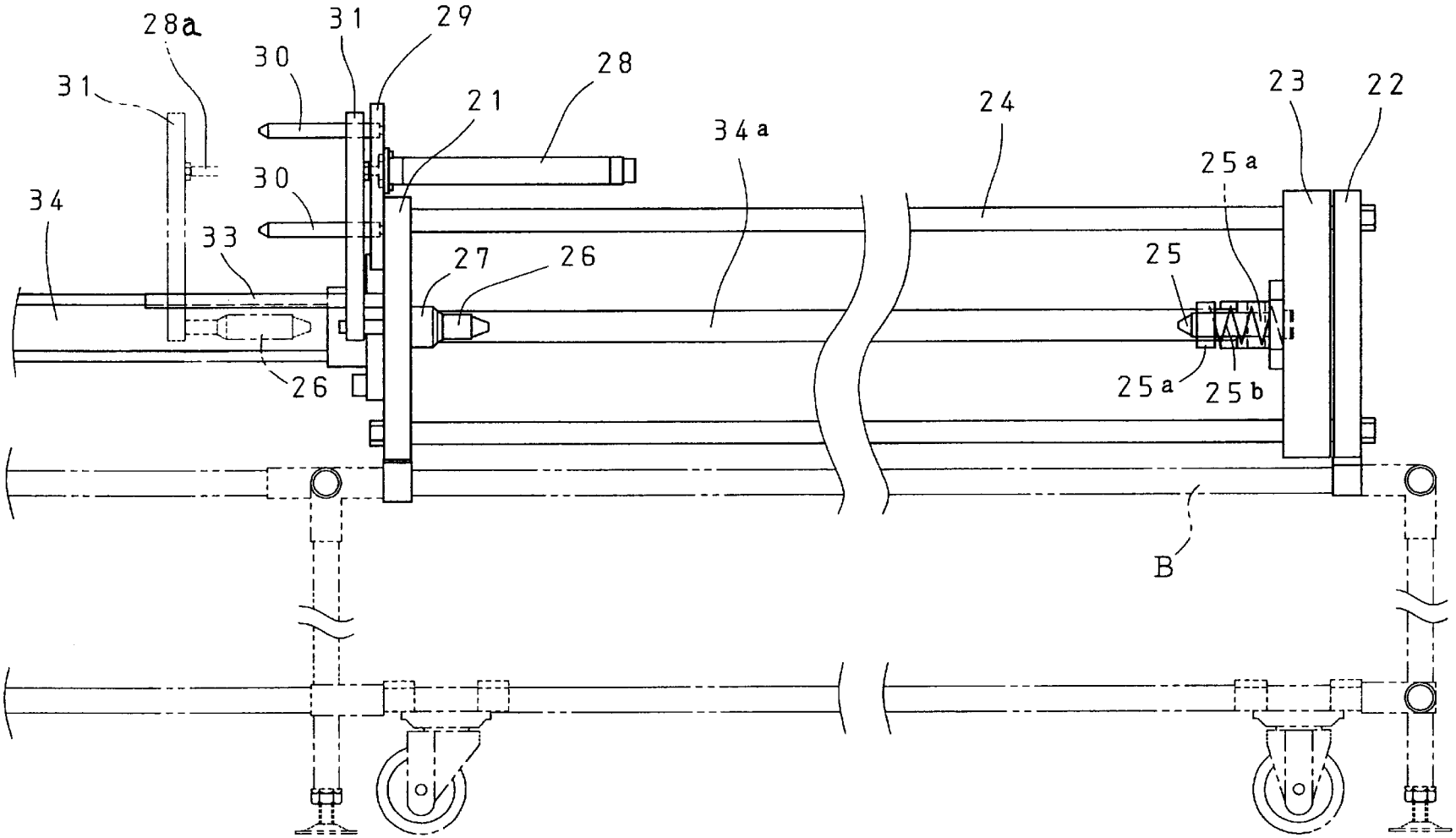
FIG. 9 is a front view of the main part of the second embodiment according to this invention.

FIGS. 8 and 9 show the aforementioned equipment 20 for removing a resin joint or resin ribs from the pipe fitted with them. The fixed plate 22 is disposed on the one end (on the right side in these drawings). Cylinder plate 21 is disposed on the other end (the left side in the drawings). These two plates are connected by stay shafts 24 in positions parallel to each other at a given distance apart. Both of the fixed plate 22 and the cylinder plate 21 are installed on the frame B and fixed thereto by given fixing means.

A hole 21*a* is drilled on the rear side of the aforementioned cylinder plate 21 at approximately half the plate height. Piston rod 34*a* is allowed to go in and out through this hole 21*a*, and is fitted perpendicularly to the outer surface of the cylinder plate 21. Moving plate 23 is fitted to the tip of the piston rod 34*a* and is disposed in a horizontally movable manner so that it moves along the stay shafts 24 between the fixed plate 22 and the cylinder plate 21 as the piston rod 34*a* moves forward and back.

An extruding pin 25 is fitted horizontally to the inner surface of the moving plate 23 at approximately half the height of the plate. The pin 25 has a conical head for easy engagement with the mouth of the pipe portion 16*a*, with the head being directed toward the cylinder plate 21.

As shown in FIGS. 8 and 9, rings 25*a* are put on the extruding pin 25 near the head and at the root. These rings 25*a* are made of a soft material, such as a resin or a nonferrous metal, so as not to give damage to the scraper 27. The rings 25*a* have an outer diameter slightly larger than that of the scraper 27. When the resin joint 16*c* is removed from the pipe portion 16*a* (see FIG. 10), it is pushed between the later described scraper 27 and the rings so that the joint can be broken or fallen. At that time, the larger outer diameter of the rings 25*a* prevents the joint from staying on the extruding pin 25.

The aforementioned rings 25*a* is kept at the extended position by a coil spring 25*b* placed inside the rings on the side of the moving plate 23. When the joint is pushed out of the pipe portion 16*a* and is handed over to the extruding pin 25, the rings 25*a* push back the joint and prevent it from staying on the pin 25.

Figure 10:
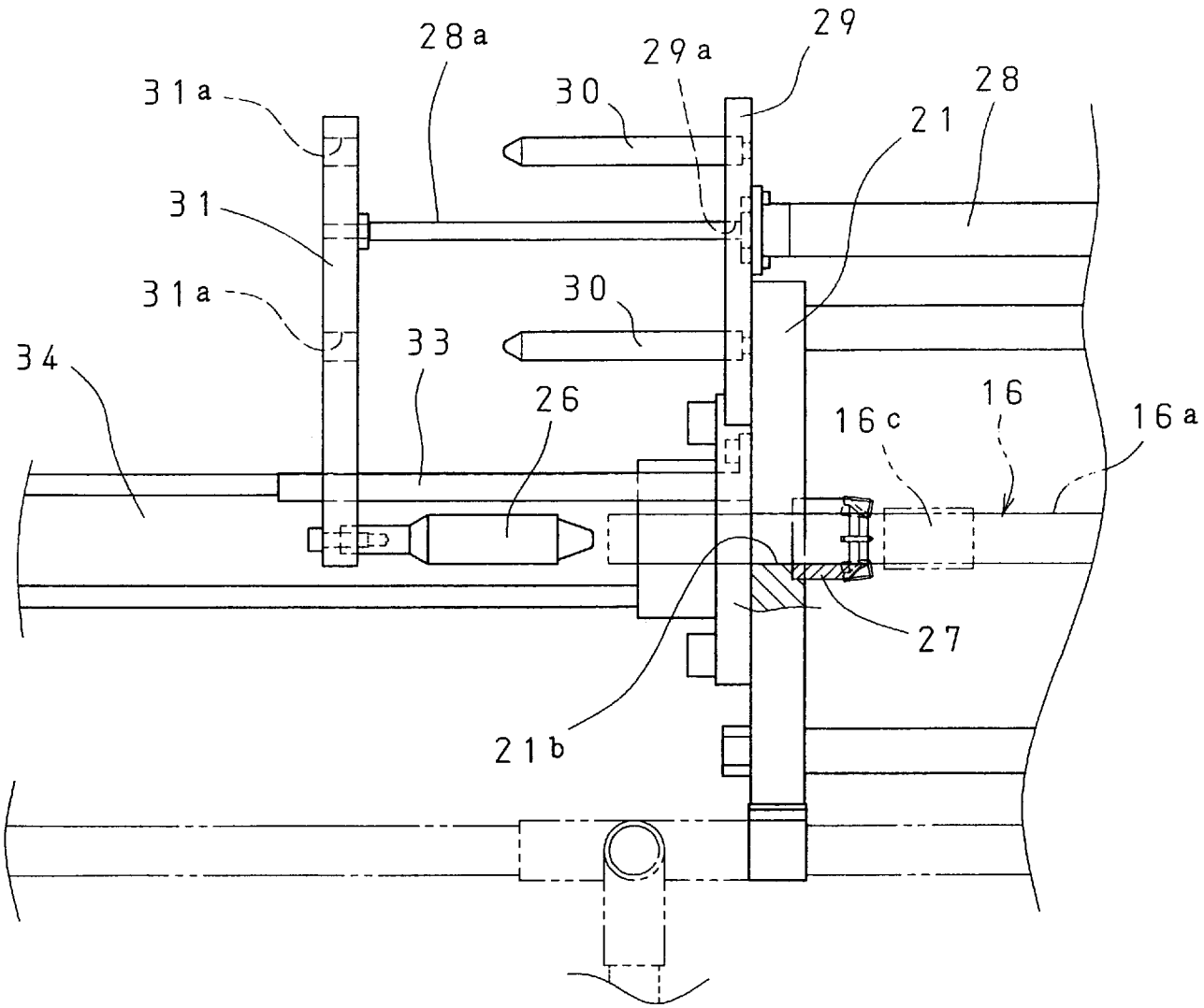
FIG. 10 is a front view of an enlarged section of equipment on the side of cylinder plate.

The aforementioned cylinder plate 21 has a pipe hole 21*b* having a slightly larger bore than the outer diameter of the pipe portion 16*a* at a position opposite to the extruding pin 25 (see FIG. 10). The scraper 27 is disposed on the inner surface of the cylinder plate 21 and has a hollow portion 27*d* with approximately the same bore as that of the pipe hole 21*b*. Cutter 27*a* is disposed in such a way as to have the same axial center as the pipe hole 21*b*, with its blades directed toward the extruding pin 25.

Figure 14:
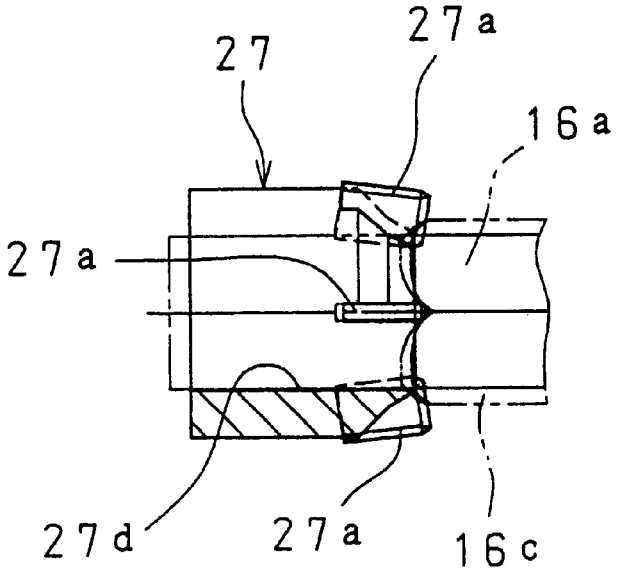
FIG. 14-A is a partial cross-sectional view of the scraper at the time when a resin joint is removed.
Figure 14:
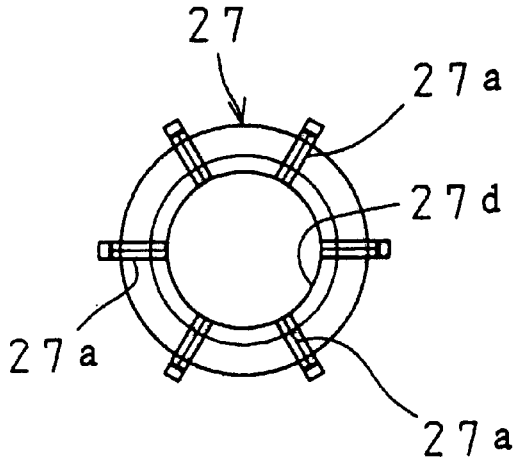

The cutter 27*a* of the scraper 27 is disposed radially from the pipe axis and is able to remove the resin joint 16*c* by breaking it (FIG. 14).

Figure 15A:
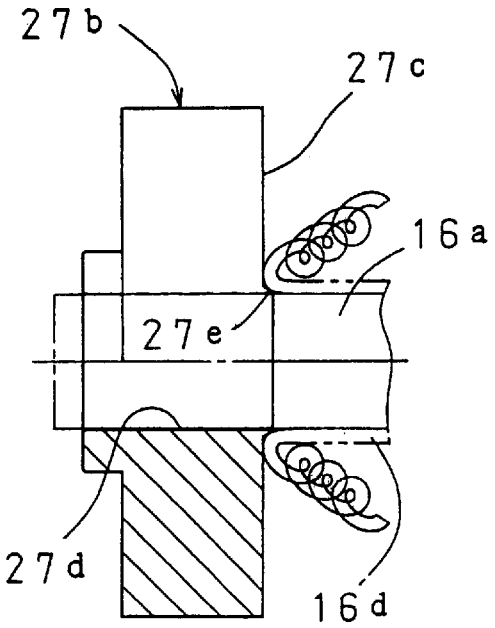
FIG. 15-A is a partial cross-sectional view of the scraper used to remove resin ribs.
Figure 15B:
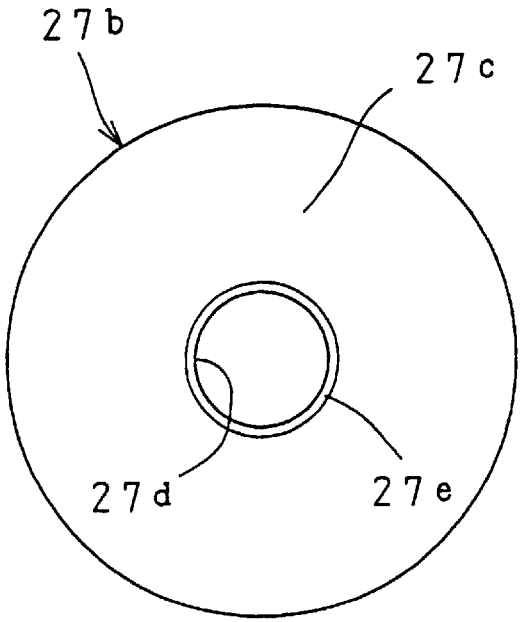
Figure 16:
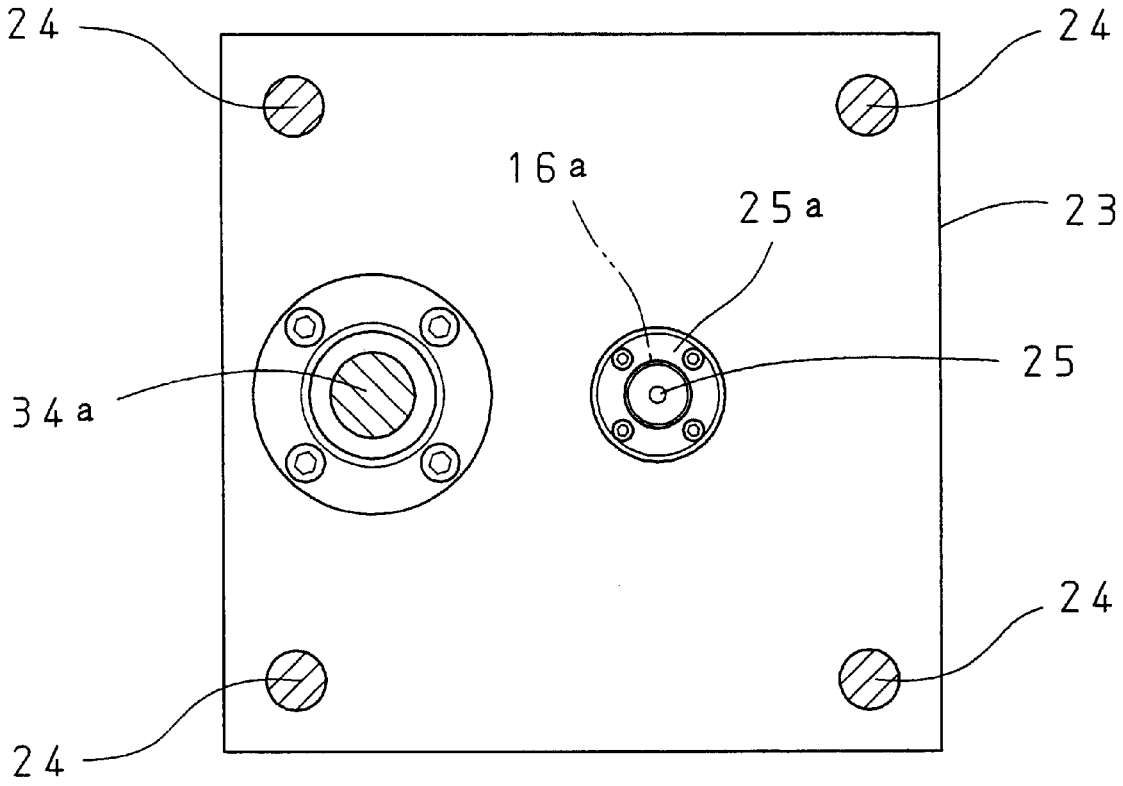
FIG. 16 is a cross-sectional view taken at the 16—16 line of FIG. 8.

When resin ribs 16*d* are removed, such a scraper 27*b* as shown in FIG. 15 is used so as to prevent the cut resin ribs 16*d* from getting bulky in their long slips or from being scattered. This scraper 27*b* is provided with a disc-like shield 27*c* to prevent the scattering of scraped resin ribs 16*d*. A hollow portion 27*d* is disposed in the approximately central area of the disc, and has a diameter slightly larger than the outer diameter of the pipe portion 16*a*. The cutter 27*e* having a cross-section of wedge shape is arranged along the inner circumference, with its blades directed toward the extruding pin 25.

A fitting plate 29 is fixed on the outer surface of the cylinder plate 21 in a position projected upward therefrom. A piston rod hole 29*a* is drilled in the upper area of the fitting plate 29. The cylinder 28 is installed horizontally on the inner surface of the fitting plate 29, and is provided with the piston rod 28*a* which is allowed to move forward and back horizontally in the outward direction (i.e., to the left of the cylinder plate 21) through the hole 29*a*. A guide pin 30 is also disposed on the outer surface of the fitting plate 29 in the direction in which the piston rod 28*a* extends. The guide pin 30 is slightly shorter than the length of the straight groove 33*a* of later-described guide plate 33.

On the outside of the fitting plate 29 and adjacently thereto, the support plate 31 is fitted rotatably to the tip of the piston rod 28*a* by the fitting screw 28*b*. Two guide pin holes 31*a* are open through the support plate 31 in its upper and central areas at positions corresponding to the guide pins 30. In the lower area of the support plate 31, the centering pin 26 is fitted perpendicularly thereto, with its head directed toward the extruding pin 25. The centering pin 26 has an outer diameter which allows the pin to pass through the pipe hole 21*b*, and the head has a conical shape so that the pin 26 can be easily engaged with the mouth of the pipe portion 16*a*.

On the rear side of the support plate 31, slider 32 is fixed at right angles thereto and a position close to the centering pin 26, and is provided with a sliding roller 32*a* to guide the centering pin 26.

Figure 11:
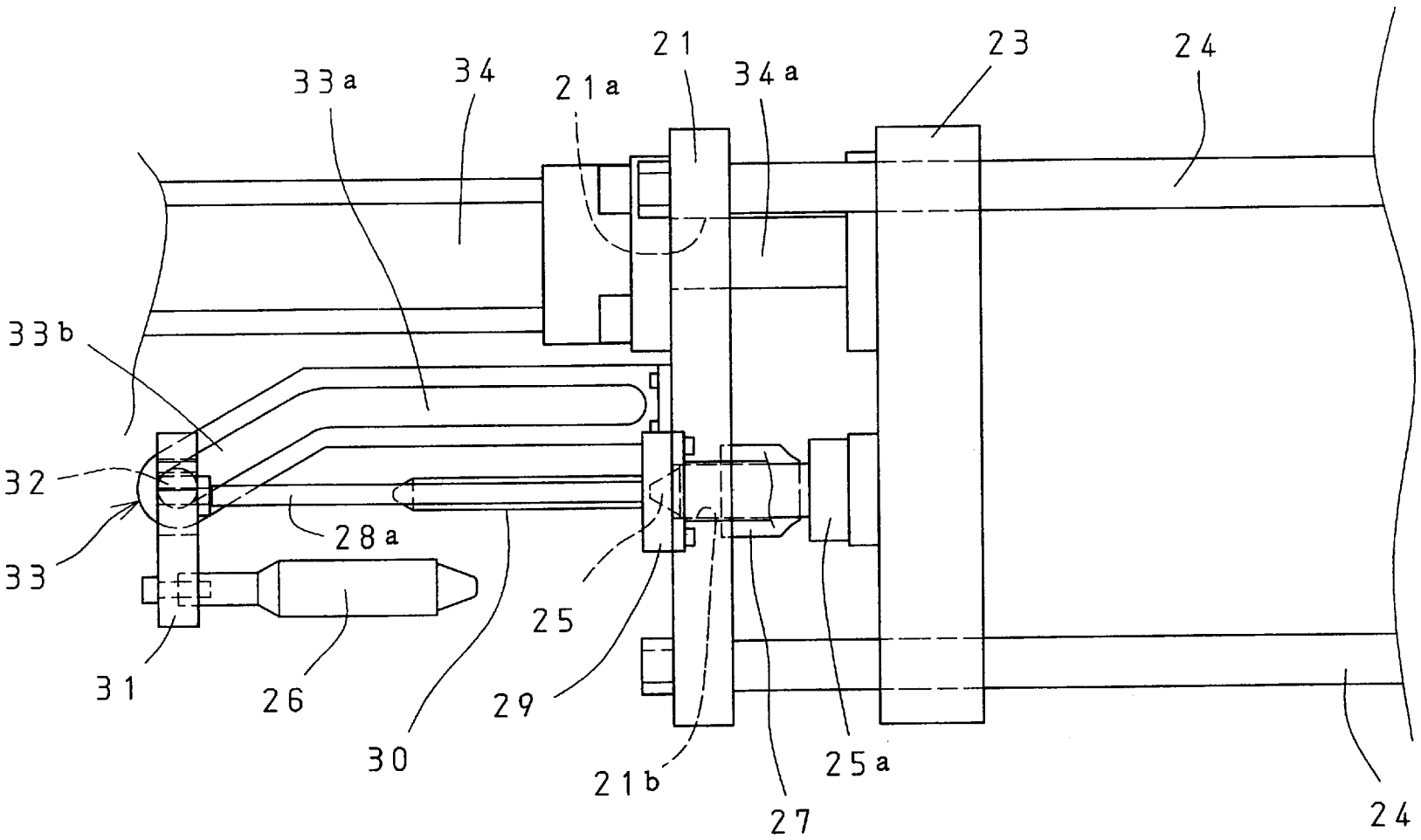
FIG. 11 is a plan view of an enlarged section of equipment on the side of cylinder plate.
Figure 13:
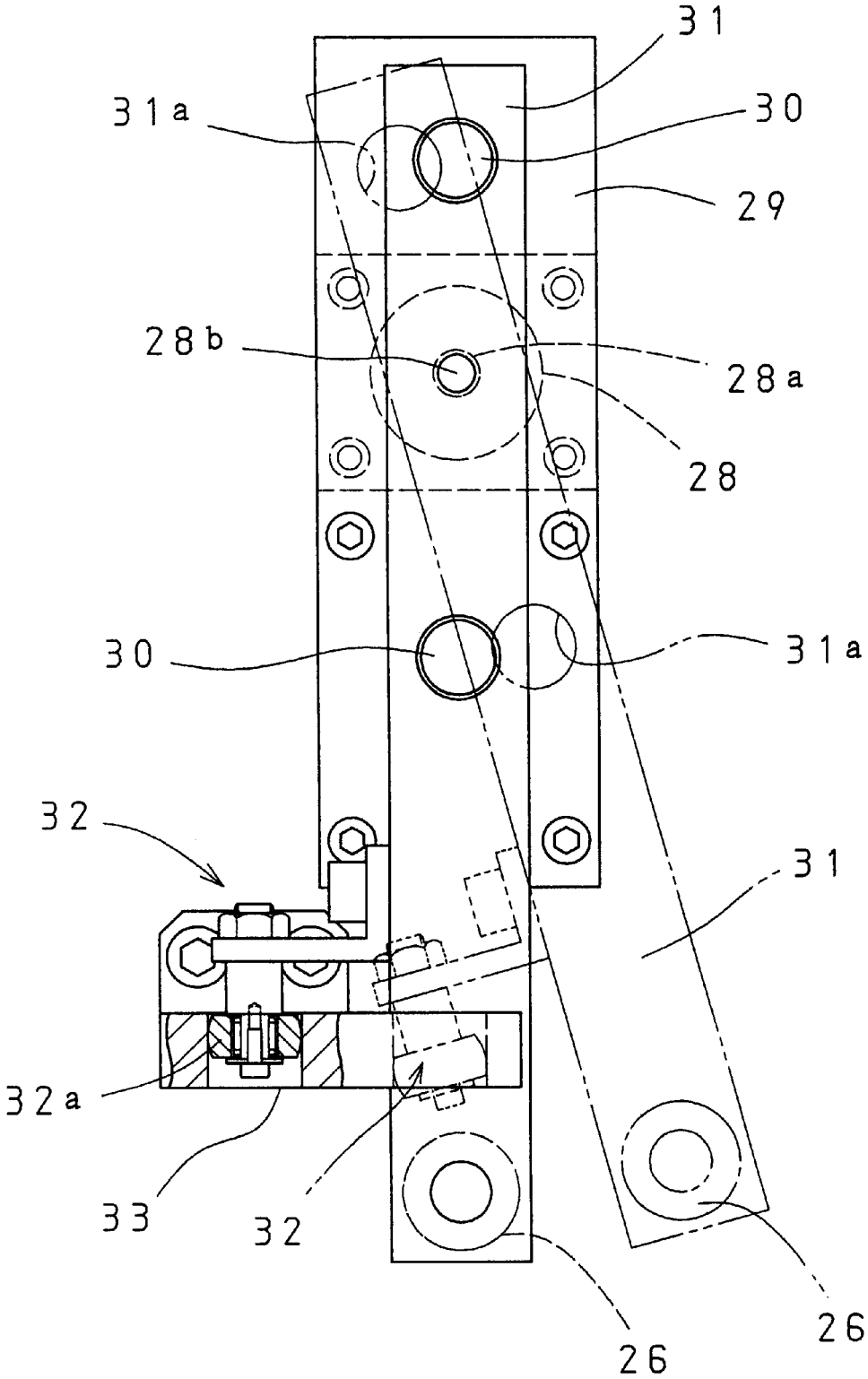
FIG. 13 is a side view of an enlarged section of FIG. 12.

A guide plate 33 is disposed on the outer surface of the cylinder plate 21 and at the position of the slider 32 (see FIGS. 11 and 13). The guide plate 33 has a straight groove 33*a*, which is engaged with the slider roller 32*a* of the slider 32, makes this slider linearly move, and guides the centering pin 26 in the axial direction to the pipe hole 21*b*. The guide plate 33 has also an escape groove 33*b*, which along with the rotation of the support plate 31, shifts the position of the centering pin 26 to this side when the pin comes out of the pipe hole 21*b*, so that the pipe portion 16*a* subsequently appearing on the left side of the cylinder plate 21 through the pipe hole 21*b* cannot be prevented from moving smoothly.

The aforementioned cylinder 28 is provided with a contactless switch (not shown) inside the cylinder 28 or at a certain position on the cylinder 28. This switch detects the pipe portion 16*a* when the centering pin 26 has passed through the scraper 27 and the pipe hole 21*b*, and at the same time, when the end of the pipe portion 16*a* has started to come out of the pipe hole 21*b*, so that the centering pin 26 does not block the passageway of the pipe portion 16*a* which comes out of the pipe hole 21*b* and further moves forward.

When both ends of the pipe portion 16*a* are to be supported by the centering pin 26 and the extruding pin 25 at respective pipe ends, the cylinder 34 is driven to make the piston rod 34*a* go back and thereby to move the moving plate 23 and the extruding pin 25 toward the cylinder plate 21. The pipe portion 16*a* is centered at the end on the side of the extruding pin 25 by pushing the pipe with this pin, and both ends of the pipe portion 16*a* are supported by the centering pin 26 and the extruding pin 25 at respective ends.

The resin joint 16*c* fitted at a middle point of the pipe portion 16*a* or the resin ribs 16*d* covering the entire pipe portion can be removed by driving back the piston rod 34*a*, thereby pushing the one end of the pipe portion 16*a* with the extruding pin 25 on the moving plate 23, allowing the pipe to pass through the scraper 27 and its hollow portion 27*b*, and pushing the resin joint 16*c* back to the rear end or cutting the resin ribs 16*d* by force right on this side of the pipe hole 21*b*.

As described above, when the pipe portion 16*a* is pushed by the extruding pin 25 and is passed through the pipe hole 21*b*, the centering pin 26 is disengaged from the pipe portion 16*a* and comes out of the pipe hole 21*b*. At that time, the contactless switch (not shown) of the cylinder 28 detects that the front end of the pipe portion 16*a* has started to come out of the pipe hole 21*b*. At the same time, the piston rod 28*a* is made to go back at a speed faster than the moving speed of the pipe portion 16*a*.

Figure 12:
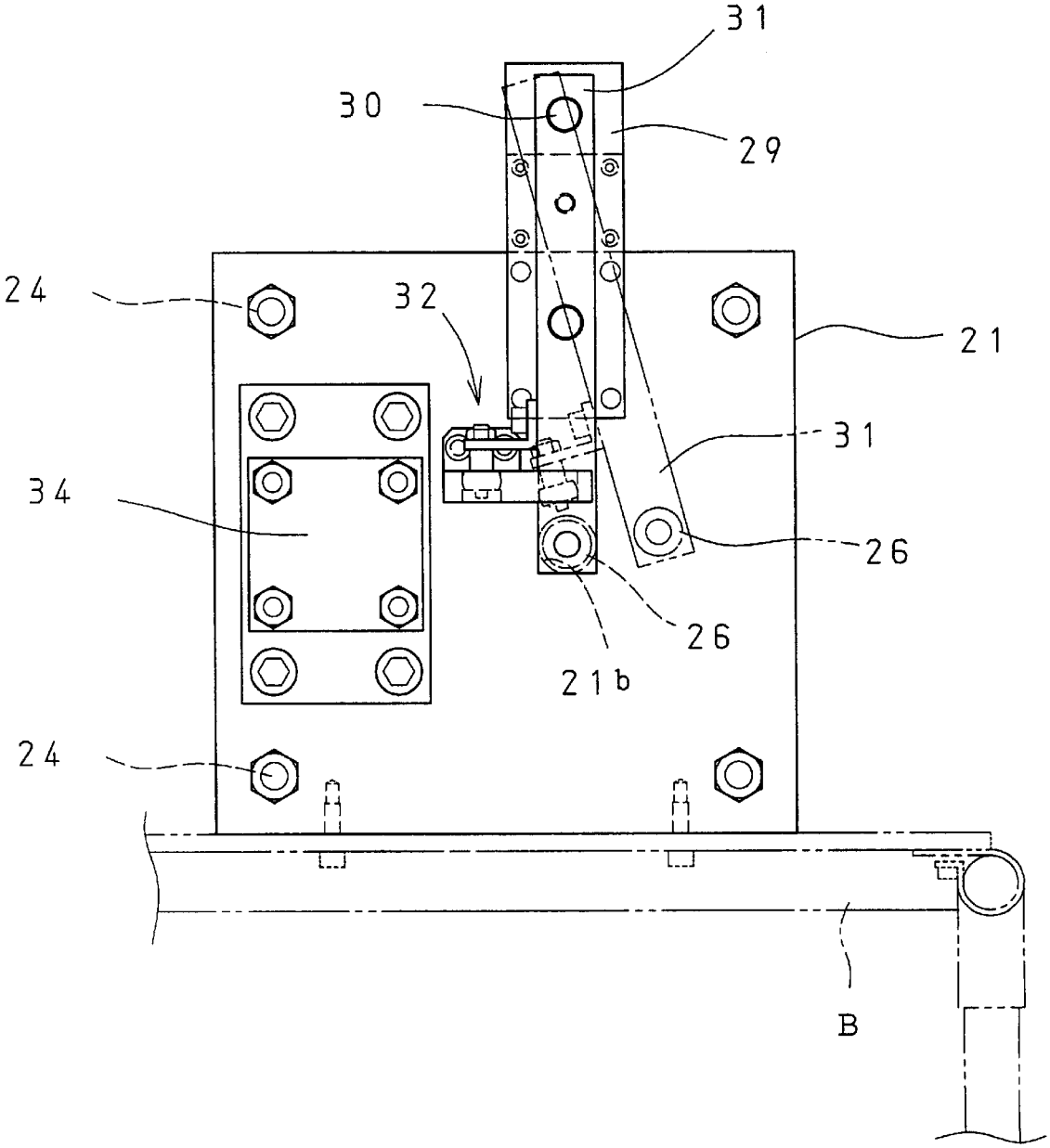
FIG. 12 is a side view of the cylinder plate taken from outside.

As shown in FIGS. 11 and 13, the sliding roller 32*a* of the slider 32 goes back in the straight groove 33*a* of the guide plate 33, and the centering pin 26 is pushed out of the pipe hole 21*b*. Thereafter, the sliding roller 32*a* is brought back in the escape groove 33*b* to let the centering pin 26 get out of the passageway of the pipe and stand by at a position in parallel to the axial direction of the pipe hole 21*b*. At its turnout, the centering pin 26 is no longer in a position to get in the passageway of the pipe portion 16*a* coming out of the pipe hole 21*b*. In this way, the long pipe, now free of the resin joint 16*c* and/or resin ribs 16*d*, is pushed through the pipe hole 21*b* by the extruding pin 25 and is released outside the cylinder plate 21. When the slider 32 moves into the escape groove 33*b*, the support plate 31 correspondingly rotates around the piston rod 28*a,* as shown by the two-dot long-dash lines (FIGS. 12 and 13).

After the pipe portion 16*a* free of the resin joint 16*c* and/or the resin rib 16*d* has been released outside the cylinder plate 21 (i.e., the left side in FIG. 8), the piston rod 34*a* is driven forward to let the moving plate 23 get back. Then the piston rod 28*a* is driven back to let the slider 32 advance in the escape groove 33*b* and then in the straight groove 33*a,* thus enabling the head of the centering pin 26 to stick out of the pipe hole 21*b* on the inside of the cylinder plate 21.

In the invention, the cylinder 5 may be of a system similar to the cylinder 34. The upper and lower scrapers 9 and 12 divided in two halves may also be replaced by a radially disposed sharp cutter.

In the invention, the cylinder 34 may be disposed on the right side of the fixed plate 22.

Figure 17:
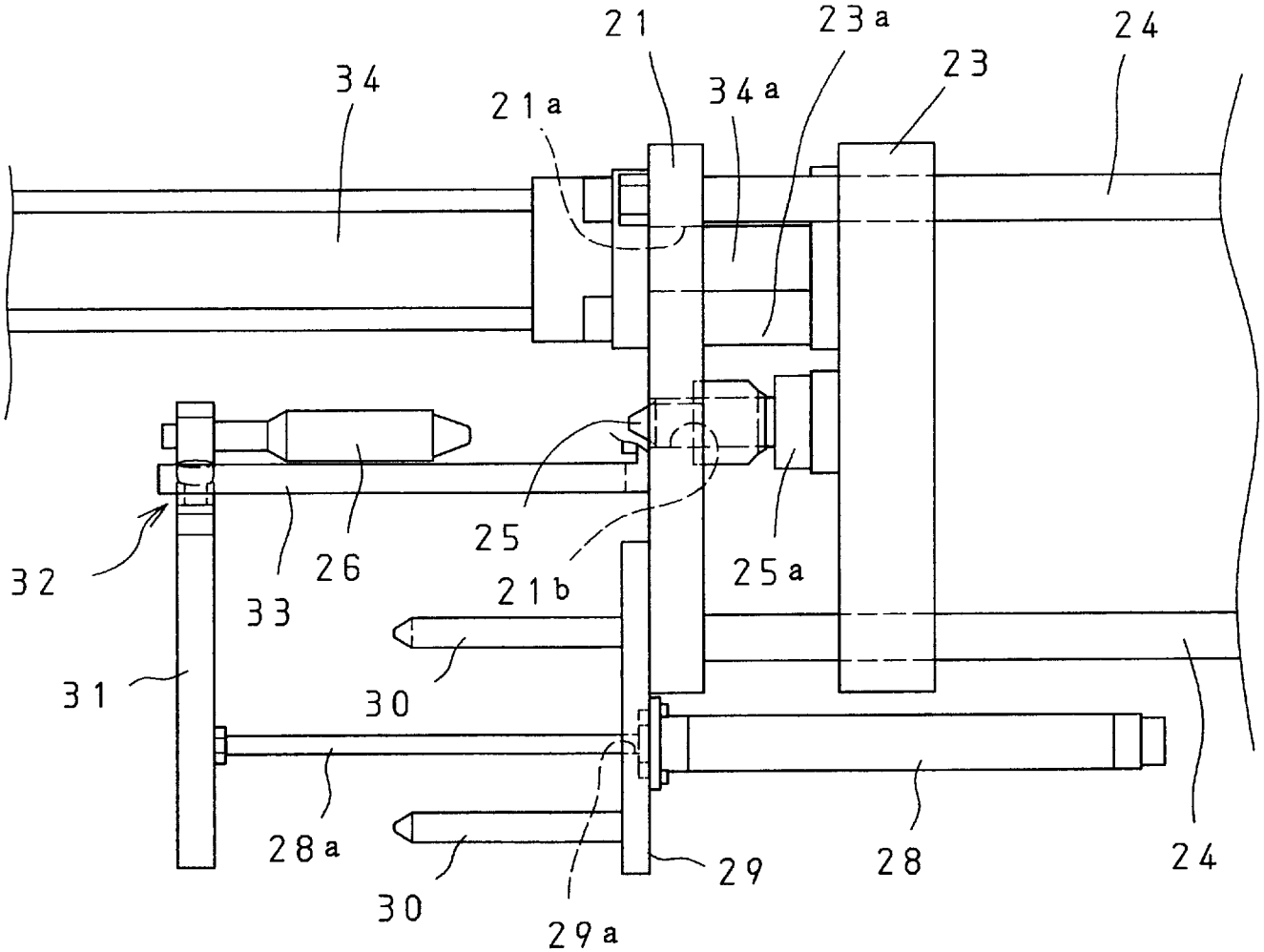
FIG. 17 is a plan view of an enlarged section of the third embodiment according to this invention.
Figure 18:
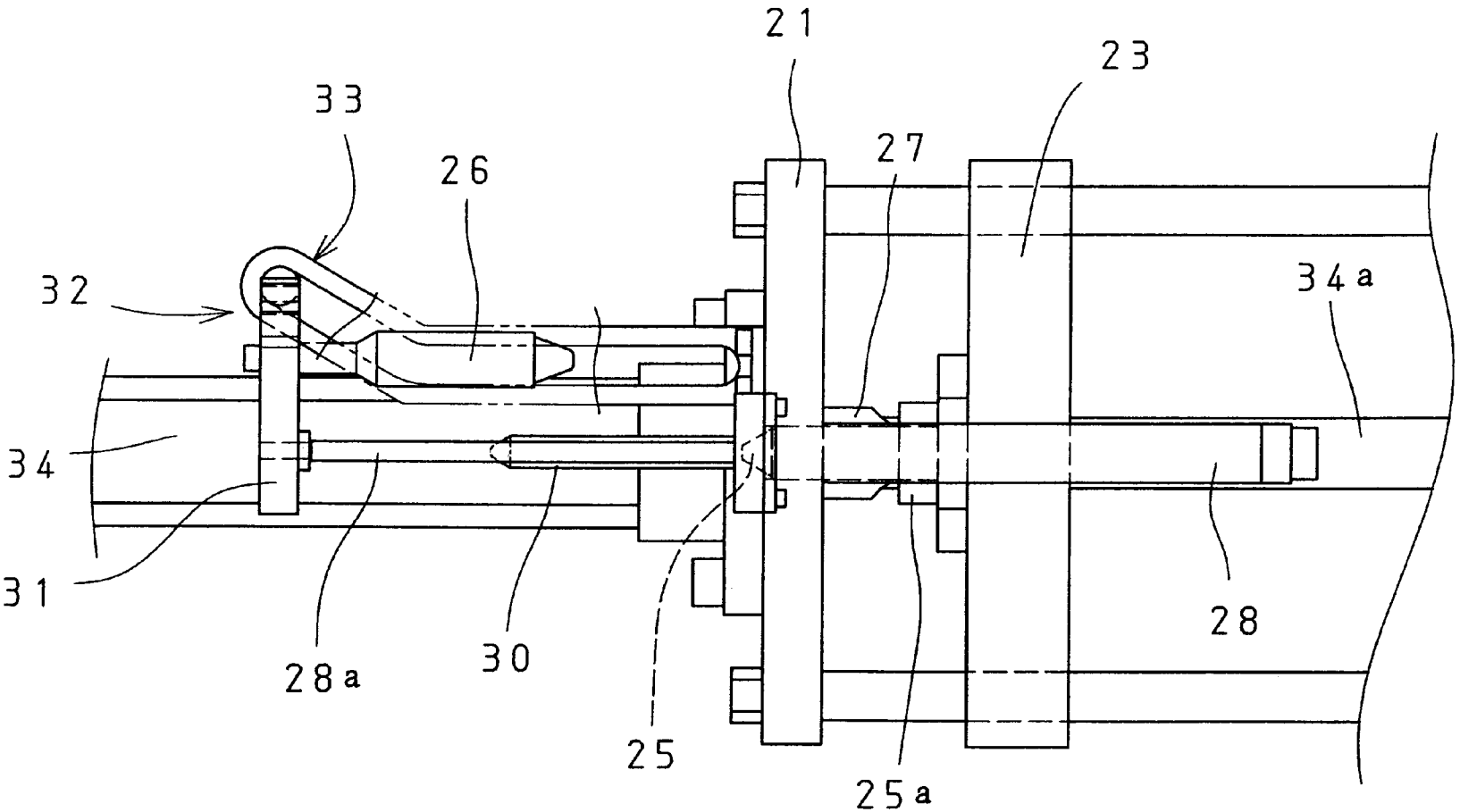
FIG. 18 is a front view of an enlarged section of the third embodiment according to this invention.
Figure 19:
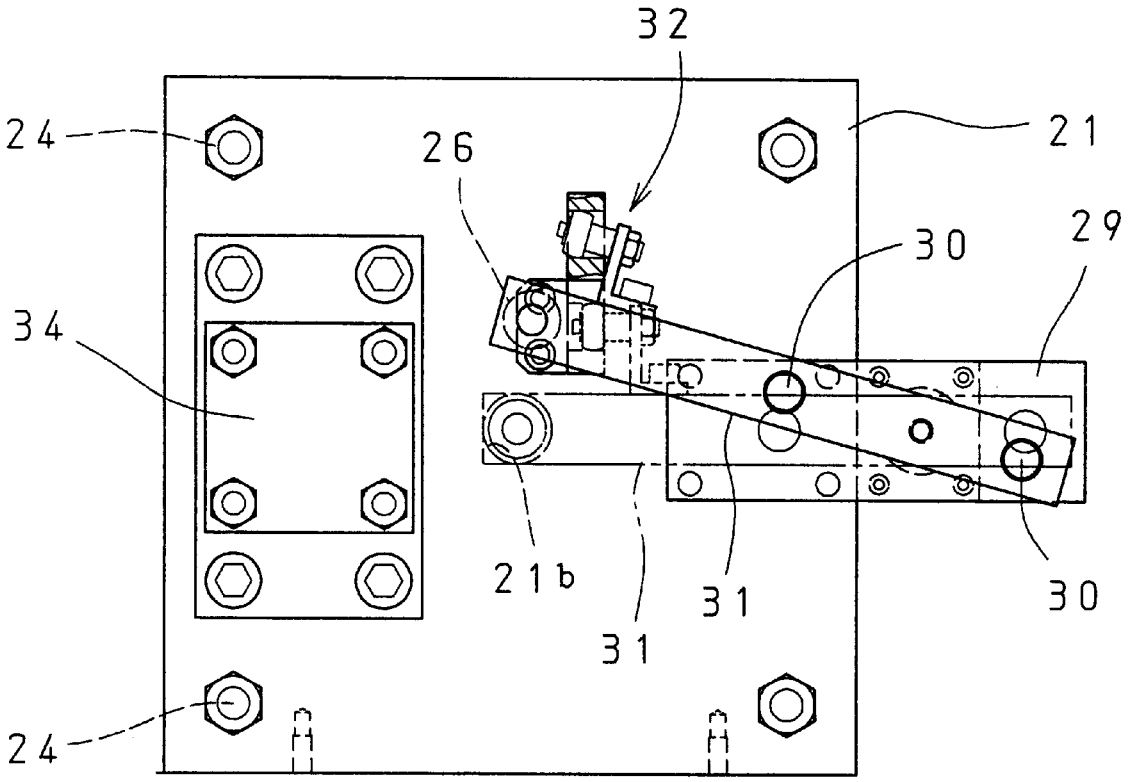
FIG. 19 is a side view of the cylinder plate of the third embodiment according to this invention taken from outside.

Referring now to FIGS. 17–19, there is illustrated the equipment of the embodiment of this invention, which makes it possible to supply, from above the equipment 20, the pipe fitted with a resin joint and/or ribs. This embodiment also makes it easy to use a robot to supply those pipes fitted with a resin joint and/or ribs, in cases where the outer diameter of the pipe is not constant. The equipment of the embodiment of FIG. 10 of this invention is identical with the embodiment of FIG. 9, except for the construction described below.

The aforementioned fitting plate 29 is disposed horizontally with its front being projected from the side edge of the cylinder plate 21, and the overlapped base area is fixed to the outer surface of the cylinder plate 21. A piston rod hole 29*a* is drilled in the area of the fitting plate 29 that is projected from the edge of the cylinder plate 21. Cylinder 28 is installed perpendicularly to the inner surface of the cylinder plate 21 and is provided with the piston rod 28*a* which passes through the piston rod hole 29*a* and extends outward (in the left direction from the cylinder plate 21) in a manner horizontally moving forward or backward.

Two guide pins 30 are disposed on the outer surface of the fitting plate 29 in a direction parallel to the extension of the piston rod 28*a*. The two guide pins 30 are slightly shorter than the length of the straight groove 33*a* of the guide plate 33. Owing to these pins 30, the centering pin 26 can be transferred with high precision at the time when the piston rod 28*a* is driven forward or back.

On the outside of the fitting plate 29, in parallel and proximity thereto, the support plate 31 is fitted to the tip of the piston rod 28*a* rotatably around the axis of the piston rod 28*a*.

Guide pin holes 31*a* are drilled through the support plate 31 at positions opposite to the guide pins 30. The centering pin 26 is fitted perpendicularly to the support plate 31 at the position opposite to the pipe hole 21*b,* with the pin head having a conical shape in a similar manner as described above and being directed toward the extruding pin 25.

The slider 32 is fixed to the support plate 31 in parallel and proximity to the centering pin 26. It is provided with the sliding roller 32*a* to guide the centering pin 26. The guide plate 33 is fixed perpendicularly to the cylinder plate 21, with the escape groove 33*b* turning upward.

The pipe 16 fitted with a resin joint can be reused if there is no damage in appearance of the pipe after the resin joint 16*b* adhered and fitted at one end of the pipe has been removed. If, however, the pipe cannot be reused because of the damage in the resin coating or on the pipe itself, or if the pipe gets rid of the resin ribs 16*d* and is made bare, then the applicant's Japanese patent No. 2533465 (Method of recovering steel pipe and coating resin separately from the resin-coated steel pipe) and U.S. Pat. No. 5,512,104 can be utilized to separate resin from steel pipe for respective recovery and effective reuse of both materials.

The preferred embodiments of the equipment according to this invention have been described above. Their effectiveness is summarized as follows:

(1) In the equipment for removing a resin joint from the pipe having the resin joint fitted thereto, the joint at or near the pipe end can be readily removed by the scraper moving in an axial direction. The pipe and the joint, which are different in material, can be recovered separately. Thus, the pipe recovered with no damage can be reused as it is. If the pipe or the resin has been damaged when the resin joint is removed, then the steel pipe and the resin can be separately recovered and recycled for effective utilization of resources.

(2) In the equipment for removing a resin joint and/or resin ribs from the pipe fitted with a resin joint and/or resin ribs, it is easy to remove the resin joint adhered and fitted at the middle point of the pipe. The pipe and the joint, which are different in material, can be recovered separately. The pipe recovered with no damage to its appearance can be reused as it is. The damaged pipe can also be recycled by separately recovering the steel pipe and the resin. In that way, resources can be effectively utilized.

(3) If resin ribs are to be removed from the coated cylindrical pipe, a scraper is moved in the axial direction to peel the resin ribs from the pipe surface and to recover bare cylindrical pipe. Thus, after the coated resin ribs have been removed, the pipe can be recovered separately from the resin. The recovered steel pipe can be reused. The peeled resin ribs can be regenerated for recycling.

(4) In the invention, it is possible for the pipe fitted with a resin joint and/or resin ribs to be supplied from above the equipment. Therefore, if the pipes fitted with a resin joint and/or resin ribs have no constant outer diameter, it is easy for a robot to be used in an automated pipe-supplying operation.

We claim:

1. Equipment for removing a resin joint from a pipe fitted with the resin joint, which is characterized by comprising:

A fixed plate; a cylinder plate having a cylinder fitted perpendicularly to the outer surface thereof, said cylinder being fitted with a piston rod extending from said cylinder and passing through a hole drilled in the approximately central area of said cylinder plate; a frame on which to mount said fixed plate and said cylinder plate, to connect them with each other by stay shafts at a given space apart and in the positions parallel to each other, and to fix them; and a moving plate disposed between said fixed plate and said cylinder plate, which is fixed to a tip of said piston rod in a manner horizontally moving along said stay shafts as said piston rod moves forward or backward;

A lower clamp portion of a V-shape disposed on a upper central part of said cylinder plate to support the pipe portion of the pipe fitted with a resin joint or two; an upper clamp portion of a reverse-V shape disposed right above said lower clamp portion; and a clamp provided with guide holes to make guide shafts pass through said holes in a horizontally movable manner, said clamp being fitted in a vertically movable manner to a tip of the piston rod of a cylinder vertically fixed to a cylinder mount vertically installed on said cylinder plate; and A V-shaped pipe support disposed on an upper central area of said moving plate, which together with said lower clamp portion, holds the pipe portion horizontally; a guide rod vertically disposed in proximity to said pipe support; a lower scraper mount fixed to the inner surface of said moving plate; a lower scraper in the shape of a lower half circle, obtained by horizontally dividing into two halves a circle with a bore slightly larger than the outer diameter of the pipe portion, said lower scraper being provided with blades fitted thereto, which are directed toward the fixed plate; and an upper scraper, being disposed right above said lower scraper and facing it correspondingly and being fitted to an upper scraper mount in a manner vertically moving along the guide rod, said upper scraper mount being fixed to one ends of the guide shafts, with the other ends being allowed to pass slidably through the guide holes of the aforementioned clamp.

2. The equipment according to claim 1 for removing a resin joint from the pipe fitted with the resin joint, wherein the upper scraper mount is fitted in a vertically movable manner to the tip of the piston rod of said cylinder installed vertically on top of the moving plate.

3. Equipment for removing a resin joint or resin ribs from a pipe fitted with a resin joint or covered with resin ribs, which is characterized by comprising:

A fixed plate; a cylinder plate having a cylinder fitted perpendicularly to the outer surface thereof, said cylinder being fitted with a piston rod extending from said cylinder and passing through a hole drilled at a given position of said cylinder plate; a frame on which to mount said fixed plate and said cylinder plate, to connect them with each other by stay shafts at a given space apart and in the positions parallel to each other, and to fix them; and a moving plate disposed between said fixed plate and said cylinder plate, which is fixed to a tip of said piston rod in a manner horizontally moving along said stay shafts as said piston rod moves forward or backward;

An extruding pin disposed in an approximately central area of said moving plate, said pin having a conical head being directed horizontally toward said cylinder plate;

A pipe hole being drilled through said cylinder plate at a position opposite to said extruding pin and having a bore slightly larger than the outer diameter of the pipe portion; and a scraper provided with a hollow portion on the inner surface of said cylinder plate, said hollow portion having a bore roughly identical with the bore of said pipe hole, with a cutter being disposed coaxially with the pipe hole and directed toward said extruding pin;

A fitting plate fixed to the outer surface of said cylinder plate in an upper area of said cylinder plate so that about a part of said fitting plate is projected upward from the top edge of said cylinder plate; a piston rod hole being drilled in said projected area; a cylinder disposed perpendicularly to the inner surface of said fitting plate and provided with a piston rod which is horizontally movable in the outward direction through said piston rod hole; guide pins fitted to the outer surface of said fitting plate in parallel to the direction in which said piston rod moves forward or backward; a support plate disposed next to and on the outside of said fitting plate and having guide pin holes in the upper area to allow said guide pins to pass through; a centering pin fixed perpendicularly to the lower area of said support plate so that said pin can be passed through the pipe hole, with the conical pin head directed toward the extruding pin; and a slider provided with a slide roller and fixed perpendicularly to said support plate which, in turn, is fitted rotatably to the tip of said piston rod; and A guide plate disposed on the outer surface of said cylinder plate and characterized by a straight groove which is engaged with said slide roller to enable said centering pin to be moved linearly inside said groove and guided in the axial direction of said pipe hole, and by an escape groove which is used to make said centering pin get out of the passageway of the pipe in parallel to the axial direction of said pipe hole.

4. The equipment according to claim 3 for removing a resin joint or resin ribs from the pipe fitted with a resin joint or covered with resin ribs, which is characterized by comprising:

A fitting plate disposed in such a way that a part of said fitting plate is projected horizontally from a side edge of said cylinder plate and fixed at an overlapped base area to the outer surface of said cylinder plate; a piston rod hole being drilled in the area of the fitting plate that is projected from the edge of the cylinder plate; a cylinder installed perpendicularly to the inner surface of said fitting plate and provided with a piston rod which passes through said piston rod hole and extends outward in a manner horizontally moving forward or backward; guide pins disposed on the outer surface of said fitting plate in parallel to the direction in which said piston rod moves forward or backward; a support plate fitted on the outside of said fitting plate in proximity and parallel thereto; and a guide plate fixed perpendicularly to the outer surface of said cylinder plate, with an escape groove turning upward.

5. The equipment according to claim 3 for removing a resin joint or resin ribs from the pipe fitted with a resin joint or covered with resin ribs, which is characterized in that said scraper has a sharp cutter, with its blades being disposed radially from the axial center.

6. The equipment according to claim 3 for removing a resin joint or resin ribs from the pipe fitted with a resin joint or covered with resin ribs, which is characterized in that the scraper for removing resin ribs is provided with a disc-like shield and a hollow portion in the approximately central area of said disc, and that said hollow portion has a bore slightly larger than the outer diameter of the pipe portion and has a ring-like cutter with a wedge-shaped cross-section, which is disposed along the inner circumference of said cutter.

* * * * *